US011024982B2

(12) United States Patent
Kim et al.

(10) Patent No.: US 11,024,982 B2
(45) Date of Patent: Jun. 1, 2021

(54) ANTENNA APPARATUS

(71) Applicant: Samsung Electro-Mechanics Co., Ltd., Suwon-si (KR)

(72) Inventors: Nam Ki Kim, Suwon-si (KR); Jae Min Keum, Suwon-si (KR); Won Cheol Lee, Suwon-si (KR); Dae Ki Lim, Suwon-si (KR); Eun Young Jung, Suwon-si (KR); Jeong Ki Ryoo, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 0 days.

(21) Appl. No.: 16/655,887

(22) Filed: Oct. 17, 2019

(65) Prior Publication Data

US 2020/0303839 A1 Sep. 24, 2020

(30) Foreign Application Priority Data

Mar. 21, 2019 (KR) ..... 10-2019-0032468
Jun. 11, 2019 (KR) ..... 10-2019-0068925

(51) Int. Cl.
*H01Q 25/00* (2006.01)
*H01Q 21/06* (2006.01)
(Continued)

(52) U.S. Cl.
CPC ..... *H01Q 25/00* (2013.01); *H01Q 1/2283* (2013.01); *H01Q 1/48* (2013.01); *H01Q 5/357* (2015.01);
(Continued)

(58) Field of Classification Search
CPC ..... H01Q 5/48; H01Q 5/357; H01Q 9/44; H01Q 9/16; H01Q 9/065; H01Q 13/085;
(Continued)

(56) References Cited

U.S. PATENT DOCUMENTS 5,557,291 A * 9/1996 Chu ..... H01Q 13/085 343/725
5,894,288 A * 4/1999 Lee ..... H01Q 13/085 343/767
(Continued)

FOREIGN PATENT DOCUMENTS

KR 10-2006-0123188 A 12/2006
KR 10-2008-0026720 A 3/2008
(Continued)

*Primary Examiner* — Ab Salam Alkassim, Jr.
(74) *Attorney, Agent, or Firm* — NSIP Law

(57) ABSTRACT

An antenna apparatus may include: a feed line; a ground plane disposed around a portion of the feed line; a feed via electrically connected to the feed line; a first end-fire antenna pattern disposed in front of the ground plane to be spaced apart from the ground plane, and electrically connected to the feed via; a second end-fire antenna pattern electrically connected to the feed line and disposed farther forward than the first end-fire antenna pattern; and a third end-fire antenna pattern electrically connected to the feed via, and disposed in front of the first end-fire antenna pattern in such a manner that a portion of the third end-fire antenna pattern overlaps the second end-fire antenna pattern.

12 Claims, 23 Drawing Sheets

(51) Int. Cl.

| | |
|---|---|
| ***H01Q 1/48*** | (2006.01) |
| ***H01Q 1/22*** | (2006.01) |
| ***H01Q 9/16*** | (2006.01) |
| ***H01Q 19/10*** | (2006.01) |
| ***H01Q 9/44*** | (2006.01) |
| ***H01Q 5/357*** | (2015.01) |

(52) U.S. Cl.
CPC ..... *H01Q 9/16* (2013.01); *H01Q 9/44* (2013.01); *H01Q 19/108* (2013.01); *H01Q 21/062* (2013.01); *H01Q 21/067* (2013.01)

(58) Field of Classification Search
CPC .. H01Q 19/108; H01Q 21/062; H01Q 21/067; H01Q 25/00
See application file for complete search history.

(56) References Cited

U.S. PATENT DOCUMENTS

| | | | | |
|---|---|---|---|---|
| 6,421,024 | B1 * | 7/2002 | Stolle | H01Q 5/25 343/792 |
| 9,270,028 | B2 * | 2/2016 | Ruvinsky | H01Q 13/18 |
| 9,570,809 | B2 * | 2/2017 | Ganchrow | H01Q 15/02 |
| 9,799,959 | B2 * | 10/2017 | Ko | H01Q 9/045 |
| 10,033,100 | B1 * | 7/2018 | Chayat | H01Q 5/30 |
| 10,305,181 | B2 * | 5/2019 | Hong | H01Q 1/38 |
| 10,608,336 | B2 * | 3/2020 | Chen | H01Q 1/48 |
| 2005/0259027 | A1 * | 11/2005 | Grebel | H01Q 1/24 343/793 |
| 2009/0073048 | A1 | 3/2009 | Kim | |
| 2012/0062437 | A1 * | 3/2012 | Hung | H01Q 5/357 343/799 |
| 2014/0361946 | A1 * | 12/2014 | Ganchrow | H01Q 19/30 343/795 |
| 2018/0090827 | A1 * | 3/2018 | Lee | G01S 7/032 |
| 2019/0109386 | A1 * | 4/2019 | Syrytsin | H01Q 5/371 |
| 2019/0173176 | A1 * | 6/2019 | Kim | H01Q 5/371 |
| 2019/0198976 | A1 * | 6/2019 | Kim | H01Q 1/38 |
| 2019/0198995 | A1 * | 6/2019 | Ryoo | H01L 24/20 |
| 2019/0207304 | A1 * | 7/2019 | Kim | H01Q 21/08 |
| 2019/0214741 | A1 * | 7/2019 | Chiang | H01Q 9/26 |
| 2020/0106171 | A1 * | 4/2020 | Shepeleva | H01Q 21/064 |
| 2020/0266523 | A1 * | 8/2020 | Park | H01Q 1/48 |
| 2020/0395677 | A1 * | 12/2020 | Kim | H01Q 21/062 |

FOREIGN PATENT DOCUMENTS

| | | | |
|---|---|---|---|
| KR | 10-0911938 | B1 | 8/2009 |
| WO | WO 2005/053092 | A1 | 6/2005 |

* cited by examiner

ANTENNA APPARATUS

CROSS-REFERENCE TO RELATED APPLICATIONS

This application claims the benefit under 35 USC § 119(a) of Korean Patent Application Nos. 10-2019-0032468 and 10-2019-0068925 filed on Mar. 21, 2019 and Jun. 11, 2019, respectively, in the Korean Intellectual Property Office, the entire disclosures of which are incorporated herein by reference for all purposes.

BACKGROUND

1. Field

The following description relates to an antenna apparatus.

2. Description of Related Art

Mobile communications data traffic is increasing rapidly on a yearly basis. Technological development to support such a leap data in real time data traffic in wireless network is underway. For example, applications of the contents of Internet of Things (IoT) based data, live VR/AR in combination with augmented reality (AR), virtual reality (VR), and social networking services (SNS), autonomous navigation, a synch view for real-time image transmission from a user's view point using a subminiature camera, and the like, require communications for supporting the exchange of large amounts of data, for example, 5th generation (5G) communications, millimeter wave (mmWave) communications, or the like.

Thus, millimeter wave (mmWave) communications including 5G (5G) communications have been researched, and research into the commercialization/standardization of antenna apparatuses to smoothly implement such millimeter wave (mmWave) communications have been undertaken.

RF signals in high frequency bands of, for example, 24 GHz, 28 GHz, 36 GHz, 39 GHz, 60 GHz and the like, are easily absorbed in the course of transmission and lead to signal loss. Thus, the quality of communications may deteriorate sharply. Therefore, antennas for communications in high frequency bands require a different technical approach from a related art antenna technology, and may require special technological development, such as for separate power amplifiers or the like, to secure antenna gain, integrate an antenna and an RFIC, and secure Effective Isotropic Radiated Power (EIRP) and the like.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an antenna apparatus includes: a feed line; a ground plane disposed around a portion of the feed line; a feed via electrically connected to the feed line; a first end-fire antenna pattern disposed in front of the ground plane to be spaced apart from the ground plane, and electrically connected to the feed via; a second end-fire antenna pattern electrically connected to the feed line and disposed farther forward than the first end-fire antenna pattern; and a third end-fire antenna pattern electrically connected to the feed via, and disposed in front of the first end-fire antenna pattern in such a manner that a portion of the third end-fire antenna pattern overlaps the second end-fire antenna pattern.

The second end-fire antenna pattern may be an open type pattern. The third end-fire antenna pattern may be a closed type pattern.

The second end-fire antenna pattern may have a shape bent diagonally with respect to a front direction of the antenna apparatus.

A portion of the third end-fire antenna pattern may have an arc shape.

The third end-fire antenna pattern may include: arc patterns, each having an arc shape; and connection patterns electrically connecting the arc patterns to each other.

A spacing distance between the arc patterns at centers of the arc patterns may be greater than a spacing distance between the arc patterns at ends of the arc patterns.

A width of each of the arc patterns may be less than a width of the second end-fire antenna pattern.

A width of each of the connection patterns may be less than a width of the feed line.

A width of the second end-fire antenna pattern may be greater than a width of the first end-fire antenna pattern.

A portion of the first end-fire antenna pattern may have a shape extending obliquely with respect to a rearward direction of the antenna apparatus.

The first end-fire antenna pattern may include: a first dipole pattern electrically connected to the feed via; and a second dipole pattern electrically connected to the feed via and having a shape extending rearwardly, obliquely with respect to the first dipole pattern.

The ground plane may include a recessed region in which a portion of the second dipole pattern is located.

In another general aspect, an antenna apparatus includes: a feed line; a ground plane disposed around a portion of the feed line; a feed via electrically connected to the feed line; a first end-fire antenna pattern disposed in front of the ground plane to be spaced apart from the first end-fire antenna pattern, and electrically connected to the feed via; and a second end-fire antenna pattern electrically connected to the feed line and disposed farther forward than the first end-fire antenna pattern, wherein the first end-fire antenna pattern includes a first dipole pattern and a second dipole pattern extending rearwardly, obliquely with respect to the first dipole pattern, and wherein a portion of the second end-fire antenna pattern has a shape extending forwardly, obliquely with respect to the first dipole pattern.

The second end-fire antenna pattern may have a shape extending from a point in front of the first and second dipole patterns in the feed line, and bent diagonally with respect to a forward direction of the antenna apparatus.

The first and second dipole patterns may extend in different directions with respect to each other from a point at which the first and second dipole patterns overlap each other. The ground plane may include a recessed region in which a portion of the second dipole pattern is located.

A width of each of the first and second dipole patterns may be less than a width of the second end-fire antenna pattern.

In another general aspect, an antenna apparatus includes: a ground plane; a feed line extending forward from the ground plane; a feed via electrically connected to the feed line; a bent dipole antenna pattern forwardly spaced from the ground plane and electrically connected to the feed via, the bent dipole antenna pattern including bent arms each having a fixed end connected to the feed line and a free end disposed forward and laterally outside of the fixed end; and a looped dipole antenna pattern electrically connected to the feed via, and overlapping the second end-fire antenna pattern in an area above the bent dipole antenna pattern.

Each of the bent arms may include a first portion connected to the feed line at the fixed end and extending laterally, perpendicular to the feed line, and a second portion extending diagonally, forward from the first portion and terminating at the free end.

The looped dipole antenna pattern may include arc-shaped patterns and connection patterns connecting the arc-shaped patterns to each other.

A width of each of the arc-shaped patterns may be less than a width of the bent dipole antenna pattern. A width of each of the connection patterns may be less than a width of the feed line.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1A:
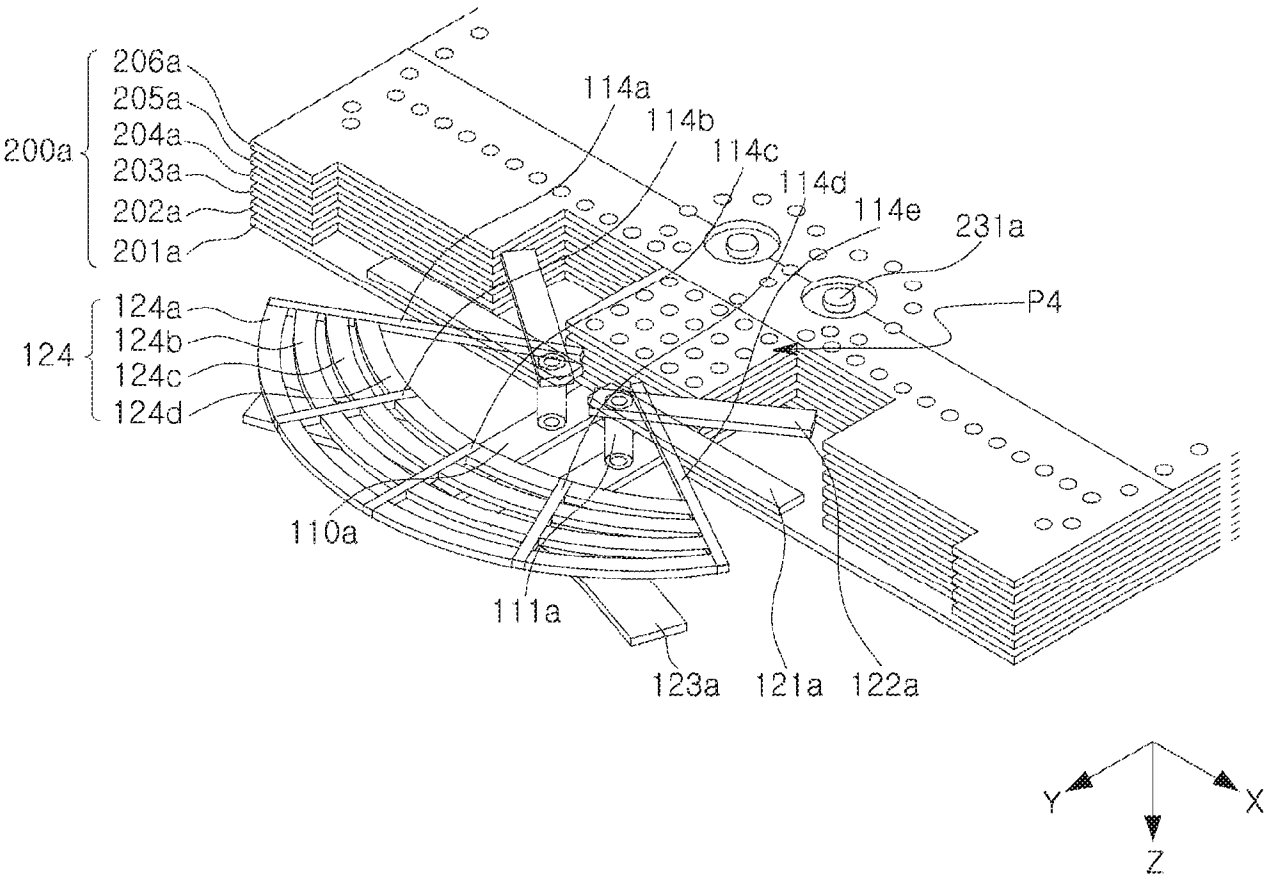
FIGS. 1A and 1B are perspective views illustrating an antenna apparatus, according to an example.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

The examples discussed in the following description provide an antenna apparatus capable of improving antenna performance or of being easily miniaturized while providing transmission/reception units in a plurality of different frequency bands.

Figure 1B:
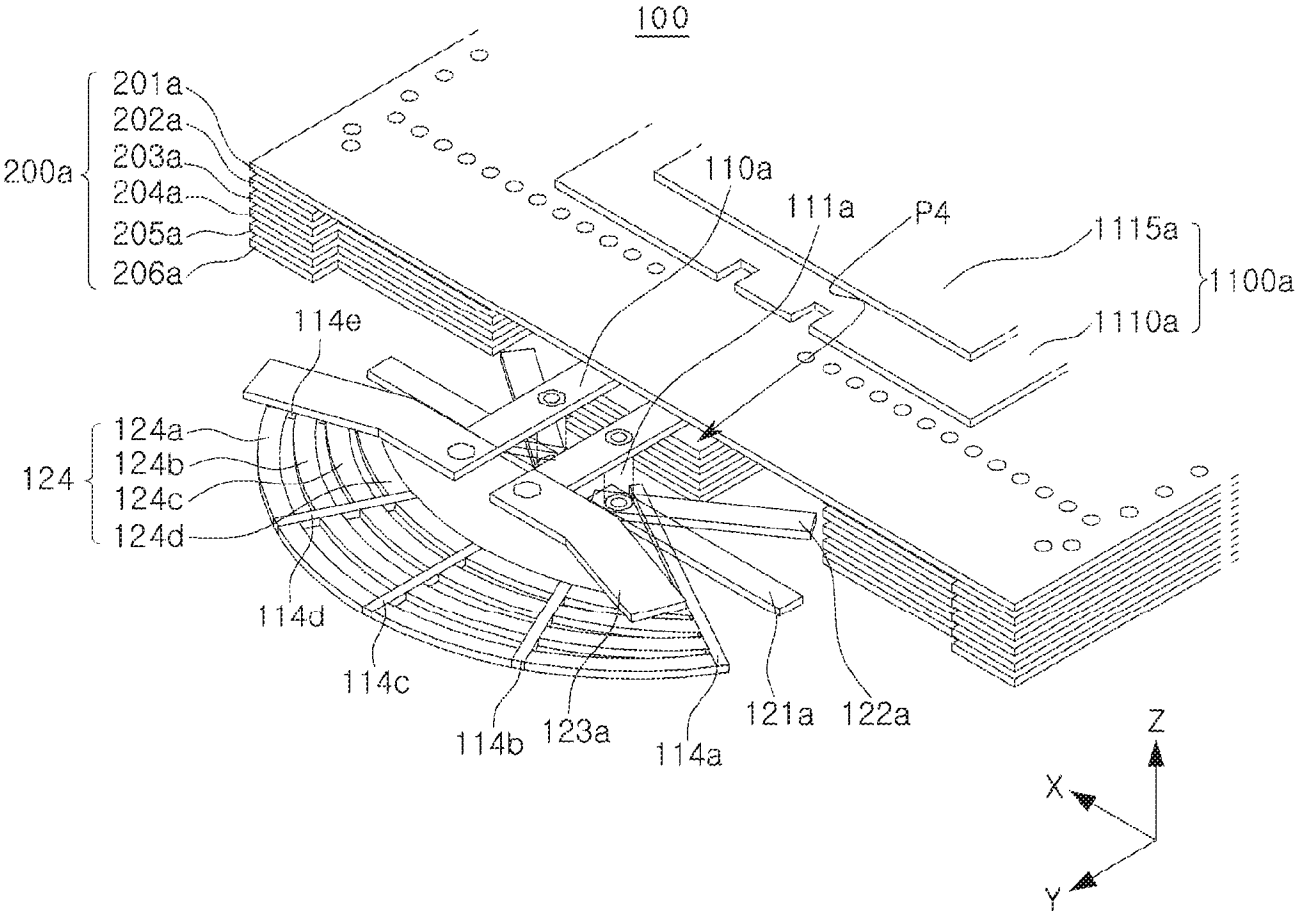
Figure 1C:
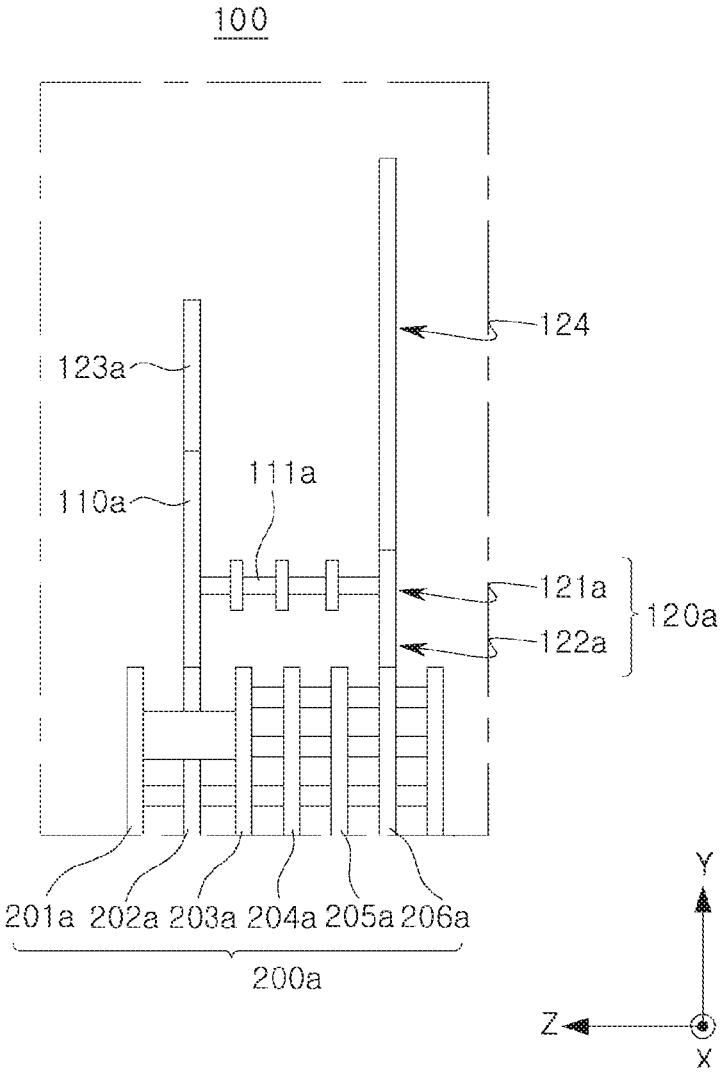
FIG. 1C is a side view of the antenna apparatus of FIGS. 1A and 1B, according to an example.
Figure 1D:
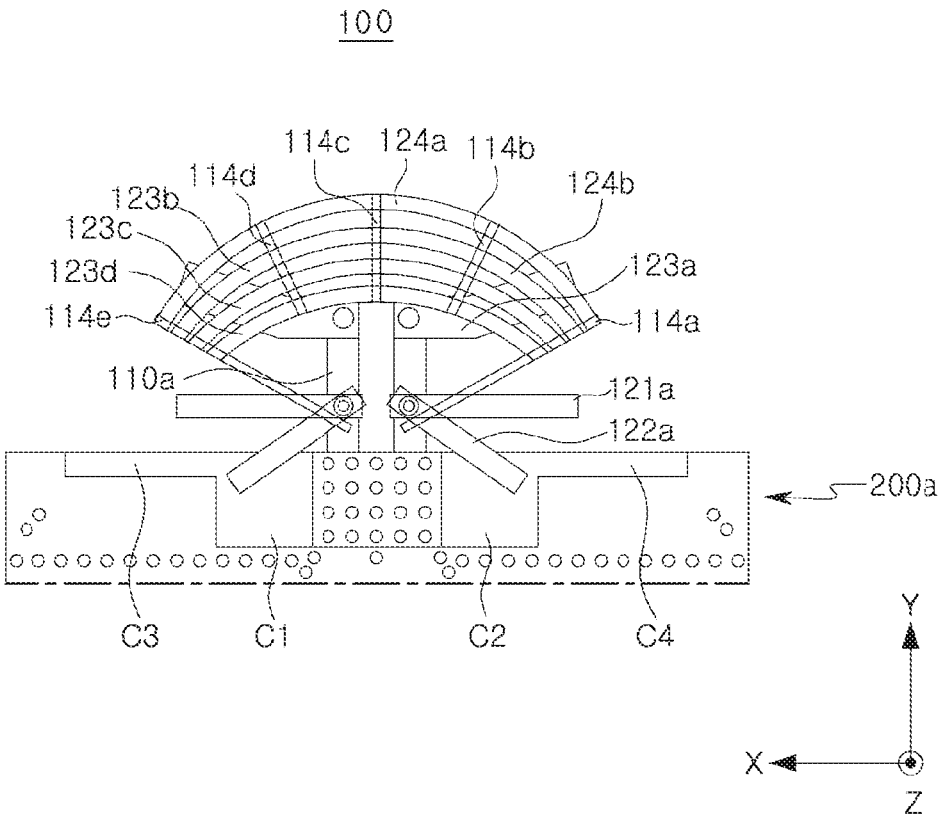
FIG. 1D is a plan view of the antenna apparatus of FIGS. 1A and 1B, according to an example.

FIGS. 1A and 1B are perspective views illustrating an antenna apparatus 100, according to an example. FIG. 1C is a side view of the antenna apparatus 100, according to an example. FIG. 1D is a plan view of the antenna apparatus 100, according to an example.

Referring to FIGS. 1A, 1B, 1C and 1D, the antenna apparatus 1 includes a first end-fire antenna pattern 120*a* and a second end-fire antenna pattern 123*a*, to provide transmission/reception units in different frequency bands. The first end-fire antenna pattern 120*a* may include either one or both of a first dipole pattern 121*a* and a second dipole pattern 122*a*.

The first and second end-fire antenna patterns 120*a* and 123*a* are electrically connected to one end of a feed line 110*a*, may receive Radio Frequency (RF) signals from the feed line 110*a* and may transmit the received signals in a forward direction, for example, in the Y direction, or may provide the RF signals received from the front of the antenna apparatus 100 to the feed line 110*a*.

The feed line 110*a* may be electrically connected to a first wiring via 231*a* in a connection member 200*a*, and the first wiring via 231*a* may be electrically connected to an Integrated Circuit (IC) disposed on a lower side thereof (for example, in a −Z direction). The IC may provide or receive RF signals to or from the first and second end-fire antenna patterns 120*a* and 123*a* through the first wiring vias 231*a* and the feed line 110*a*.

The feed line 110*a* may have a structure in which a transmission path of a first RF signal in a first frequency band (for example, of 28 GHz) and a transmission path of a second RF signal in a second frequency band (for example, of 39 GHz) are shared. Accordingly, since the number of the feed lines 110*a* may be reduced, the size occupied by the RF signal transmission paths in the connection member 200*a* may be reduced, and an overall size of the antenna apparatus 1 may be reduced.

For example, the feed line 110*a* may include first and second feed lines. The first and second feed lines may be electrically connected to one and the other pole of the first and second end-fire antenna patterns 120*a* and 123*a*, respectively.

The first and second end-fire antenna patterns 120*a* and 123*a* resonate with respect to the first and/or second frequency bands, respectively, to intensively receive energy corresponding to the first and second RF signals.

Since the connection member 200*a* may reflect first and second RF signals radiated toward the connection member 200*a* among the first and second RF signals radiated by the first and second end-fire antenna patterns 120*a* and 123*a*, radiation patterns of the first and second end-fire antenna patterns 120*a* and 123*a* may be concentrated forward (for example, in the Y direction). Accordingly, gains of the first and second end-fire antenna patterns 120*a* and 123*a* may be improved.

The resonance of the first and second end-fire antenna patterns 120*a* and 123*a* may be generated based on a resonance frequency depending on combination of inductance and capacitance corresponding to the first and second end-fire antenna patterns 120*a* and 123*a*, and peripheral structures thereof.

Each of the first and second end-fire antenna patterns 120*a* and 123*a* may have bandwidths based on an intrinsic resonant frequency by an intrinsic element (for example, a shape, a size, a thickness, a spacing distance or a dielectric constant of an insulating layer, or the like) and an extrinsic resonant frequency due to electromagnetic coupling with an adjacent pattern and/or via.

The first and second dipole patterns 121*a* and 122*a* are smaller than the second end-fire antenna pattern 123*a*, and may thus have inductance and/or capacitance lower than inductance and/or capacitance based on the intrinsic element of the second end-fire antenna pattern 123*a*, thereby resonating dominantly with respect to the second RF signal having a relatively short wavelength among the first and second RF signals.

The second end-fire antenna pattern 123*a* may dominantly resonate with respect to the first RF signal, and may also affect the first RF signal resonance of the first dipole pattern 121*a*.

The connection member 200*a* may reflect the first and second RF signals. The first and second RF signals reflected by the connection member 200*a* may act as constructive interference and/or destructive interference, with respect to first and second RF signals directed from the first and second end-fire antenna patterns 120*a* and 123*a* in the forward direction (for example, in the Y direction).

In this example, a rate of constructive interference in the total interference of the first and second RF signals may be increased, when a distance between the first and second end-fire antenna patterns 120*a* and 123*a* and the connection member 200*a* is equal to or greater than a specific distance, for example, ¼ times the wavelength of the RF signal.

Since the second end-fire antenna pattern 123*a* is larger than the first and second dipole patterns 121*a* and 122*a*, a distance between the second end-fire antenna pattern 123*a* and the connection member 200*a* may be greater than a distance between the first and second dipole patterns 121*a* and 122*a* and the connection member 200*a*. Accordingly, a rate of the constructive interference of each of the first and second end-fire antenna patterns 120*a* and 123*a* may be increased, and a gain of each of the first and second end-fire antenna patterns 120*a* and 123*a* may be improved.

At least a portion of the first end-fire antenna pattern 120*a* may have a shape that extends diagonally with respect to a backward direction thereof. For example, the second dipole pattern 122*a* may have a shape that extends backward obliquely with respect to the first dipole pattern 121*a*.

Accordingly, a fourth resonance frequency of the second dipole pattern 122*a* may be higher than a third resonance frequency of the first dipole pattern 121*a*, and radiation patterns of the first and second dipole patterns 121*a* and 122*a* may be formed to increase a specific gravity of the constructive interference with respect to mutual radiation patterns.

Accordingly, electromagnetic complementarity of the first and second dipole patterns 121*a* and 122*a* with respect to each other may be enhanced, and the first end-fire antenna pattern 120*a* may have a relatively wide bandwidth depending on a combination of the third resonance frequency and the fourth resonance frequency.

A feed via 111*a* may electrically connect the first end-fire antenna pattern 120*a* and the feed line 110*a* to each other. For example, the first end-fire antenna pattern 120*a* may be disposed below the feed line 110*a* by the feed via 111*a*.

A −Z direction vector component of the second RF signal of the first end-fire antenna pattern 120*a* may be added to the second RF signal by a −Z direction path provision in the feed via 111*a*. Therefore, a radiation pattern of the first end-fire antenna pattern 120*a* may be inclined from a forward direction (for example, the Y direction) to—the −Z direction.

In addition, the second end-fire antenna pattern 123*a* may be located on a different height from the first end-fire antenna pattern 120*a* due to the feed via 111*a*.

Accordingly, the first end-fire antenna pattern 120*a* may not be blocked by the second end-fire antenna pattern 123*a*, while concentrating the radiation pattern forward (for example, in the Y direction), and therefore, deterioration of gain corresponding to the second RF signal may be suppressed.

Referring to FIGS. 1A, 1B, 10, and 1D, the antenna apparatus 1 may further include a third end-fire antenna pattern 124. The third end-fire antenna pattern 124 may be electrically connected to the feed via 111*a*.

For example, one end and another end of the third end-fire antenna pattern 124 may be electrically connected to the first and second feed lines of the feed via 111*a*, respectively. For example, the third end-fire antenna pattern 124 may be a closed type pattern that is different from the open type patterns of the first and second end-fire antenna patterns 120*a* and 123*a*. That is, the third end-fire antenna pattern 124 may be a looped dipole antenna pattern. Since an overlap structure of the open structure of the first and second end-fire antenna patterns 120*a* and 123*a* and the closed structure of the third end-fire antenna pattern 124 increases the concentration of electromagnetic coupling, electromagnetic coupling concentration of the second and third end-fire antenna patterns 123*a* and 124 may be improved, and a gain of the second RF signals of the second and third end-fire antenna patterns 123*a* and 124 may be improved.

The third end-fire antenna pattern 124 may be electrically connected to the feed line 110*a* and/or the feed via 111*a*, and may thus have an inherent resonant frequency. For example, when the inherent resonant frequency corresponds to a frequency of the first and/or second RF signal, a radiation pattern for the first and/or second RF signal may be formed.

An intrinsic element of the third end-fire antenna pattern 124 may be designed to have a second resonance frequency adjacent to a first resonance frequency of the second end-fire antenna pattern 123*a*.

Accordingly, the second and third end-fire antenna patterns 123*a* and 124 may have a relatively wide bandwidth by a combination of the first resonance frequency and the second resonance frequency. The second and third end-fire antenna patterns 123*a* and 124 may also be designed to have a relatively high gain depending on a narrowband design of the first resonance frequency and the second resonance frequency.

The third end-fire antenna pattern 124 may be located at a different height from the second end-fire antenna pattern 123*a* due to the feed via 111*a*.

At least a portion of the third end-fire antenna pattern 124 may be disposed to overlap the second end-fire antenna pattern 123*a* in a vertical direction (for example, the Z direction).

Accordingly, the radiation patterns of the second and third end-fire antenna patterns 123*a* and 124 may be formed to increase the specific gravity of constructive interference with respect to the radiation patterns of the second and third end-fire antenna patterns 123*a* and 124, respectively. For example, electromagnetic complementarity of the second and third end-fire antenna patterns 123*a* and 124 with respect to each other may be enhanced.

One end and another end of the third end-fire antenna pattern 124 may be concentrated on the feed via 111*a*. In this case, the third end-fire antenna pattern 124 may have a shape extending in a direction different from that of the first and second dipole patterns 121*a* and 122*a*.

Thus, a phenomenon in which the third end-fire antenna pattern 124 electromagnetically blocks the first and second dipole patterns 121*a* and 122*a* in a forward direction, for example, in the Y direction, may be suppressed. Therefore, an overall gain of frequency bands of the antenna apparatus 1 may be improved.

At least a portion of the third end-fire antenna pattern 124 may have the form of an arc. Accordingly, the third end-fire antenna pattern 124 may improve the electromagnetic complementarity of the second end-fire antenna pattern 123*a* while reducing an influence on the gain of the first and second dipole patterns 121*a* and 122*a*.

In other words, the arc of the third end-fire antenna pattern 124 may function as an electromagnetic plane through which a surface current corresponding to the first RF signal flows. The electromagnetic plane may function as if an area in which the surface current flow in the second end-fire antenna is expanded. Accordingly, the gain of the first RF signal of the antenna apparatus according to an example may be significantly improved.

Since the third end-fire antenna pattern 124 overlaps the second end-fire antenna pattern 123*a*, a size of the antenna apparatus 1 is minimally increased by the third end-fire antenna pattern 124. Thus, in comparison to the related art, the antenna apparatus 1 may have improved antenna performance (for example, gain, bandwidth or directivity), without substantially increasing the antenna size.

For example, the third end-fire antenna pattern 124 may include arc patterns 124*a*, 124*b*, 124*c*, and 124*d* having an arc shape, and may include connection patterns 114*a*, 114*b*, 114*c*, 114*d*, and 114*e* electrically connecting the arc patterns 124*a*, 124*b*, 124*c* and 124*d* to each other.

For example, when a frequency of the RF signal is high, an overall structure of the arc patterns 124*a*, 124*b*, 124*c*, and 124*d*, the connection patterns 114*a*, 114*b*, 114*c*, 114*d*, and 114*e* and gaps therebetween may serve as an electromagnetic plane.

Accordingly, a width of an electromagnetic coupling range between the second and third end-fire antenna patterns 123*a* and 124 may be greater than a total width of the arc patterns 124*a*, 124*b*, 124*c*, and 124*d*. Therefore, a gain of the first RF signal of the second and third end-fire antenna patterns 123*a* and 124 as compared with the device size may be further improved.

For example, a width of each of the arc patterns 124*a*, 124*b*, 124*c*, and 124*d* may be less than a width of the second end-fire antenna pattern 123*a*. Accordingly, the coupling concentration per unit area due to the overlap of the second and third end-fire antenna patterns 123*a* and 124 may be further increased, and the gain of the second and third end-fire antenna patterns 123*a* and 124 may be further improved by electromagnetic coupling.

For example, a width of each of the connection patterns 114*a*, 114*b*, 114*c*, 114*d*, and 114*e* may be less than a width of the feed line 110*a*. Accordingly, a surface current ratio between the second and third end-fire antenna patterns 123*a* and 124 may be suitable, and thus, the gain of the second and third end-fire antenna patterns 123*a* and 124 may be further improved by electromagnetic coupling.

For example, a distance between the arc patterns 124*a*, 124*b*, 124*c*, and 124*d* (e.g., a distance between adjacent arc patterns among the arc patterns 124*a*, 124*b*, 124*c*, and 124*d*) at the centers of the arc patterns 124*a*, 124*b*, 124*c* and 124*d* (e.g., centers with respect to the X direction) may be greater than a distance between the arc patterns 124*a*, 124*b*, 124*c* and 124*d* (e.g., a distance between adjacent arc patterns among the arc patterns 124*a*, 124*b*, 124*c*, and 124*d*) at ends thereof. Accordingly, the third end-fire antenna pattern 124 has a structure that further protrudes generally forward (for example, in the Y direction), and the radiation pattern of the third end-fire antenna pattern 124 may thus be further concentrated in the forward direction, and the gain of the third end-fire antenna pattern 124 may be further improved.

The second end-fire antenna pattern 123*a* may have a shape bent in a forward oblique direction while extending in an X direction at a central portion of the end-fire antenna pattern 123*a*. For example, the second end-fire antenna pattern 123*a* may include bent arms each having a fixed end connected to the feed line 110*a* and a free end disposed forward and laterally outside of the fixed end. More specifically, for example, each of the bent arms may include a first portion connected to the feed line 110*a* at the fixed end and extending laterally, perpendicular to the feed line 110*a*, and a second portion extending diagonally, forward from the first portion and terminating at the free end. Accordingly, the radiation pattern of the second end-fire antenna pattern 123*a* may have an open protruding structure that is concentrated forward (for example, in the Y direction). The open protruding structure may have relatively high electromagnetic complementarity with a closed protruding structure of the third end-fire antenna pattern 124. Accordingly, the second and third end-fire antenna patterns 123*a* and 124 may have a relatively higher gain of the first RF signal.

In addition, a width of the second end-fire antenna pattern 123*a* may be greater than a width of the first end-fire antenna pattern 120*a*. Accordingly, the first RF signal transmitted from the feed line 110*a* may be more attracted to the second and third end-fire antenna patterns 123*a* and 124, and thus, electromagnetic isolation between the first and second RF signals may be further improved.

Referring to FIGS. 1A to 1D, the connection member 200*a* may have a structure in which ground planes 201*a*, 202*a*, 203*a*, 204*a*, 205*a*, and 206*a* are stacked. The number of the ground planes 201*a*, 202*a*, 203*a*, 204*a*, 205*a*, and 206*a* is not particularly limited.

At least one of the ground planes 201*a*, 202*a*, 203*a*, 204*a*, 205*a*, and 206*a* surrounds a portion of the feed line 110*a* and may be disposed to the rear of the first, second and third end-fire antenna patterns 120*a*, 123*a* and 124.

For example, the ground planes 201*a*, 202*a*, 203*a*, 204*a*, 205*a*, and 206*a* may have a protruding region P4 and recessed regions C1, C2, C3 and C4.

A portion of the second dipole pattern 122*a* of the first end-fire antenna pattern 120*a* may be located in the recessed regions C1, C2, C3 and C4.

For example, the first dipole pattern 121*a* of the first end-fire antenna pattern 120*a* has an adaptive form with respect to the structures of the second and third end-fire antenna patterns 123*a* and 124, and the second dipole pattern 122*a* may have an adaptive form with respect to the structure of at least one of ground planes 201*a*, 202*a*, 203*a*, 204*a*, 205*a*, and 206*a*.

For example, the first end-fire antenna pattern 120*a* improves electromagnetic isolation between the first and second RF signals, and improves reflection efficiency for the second RF signal to further improve the gain of the second RF signal.

Figure 2A:
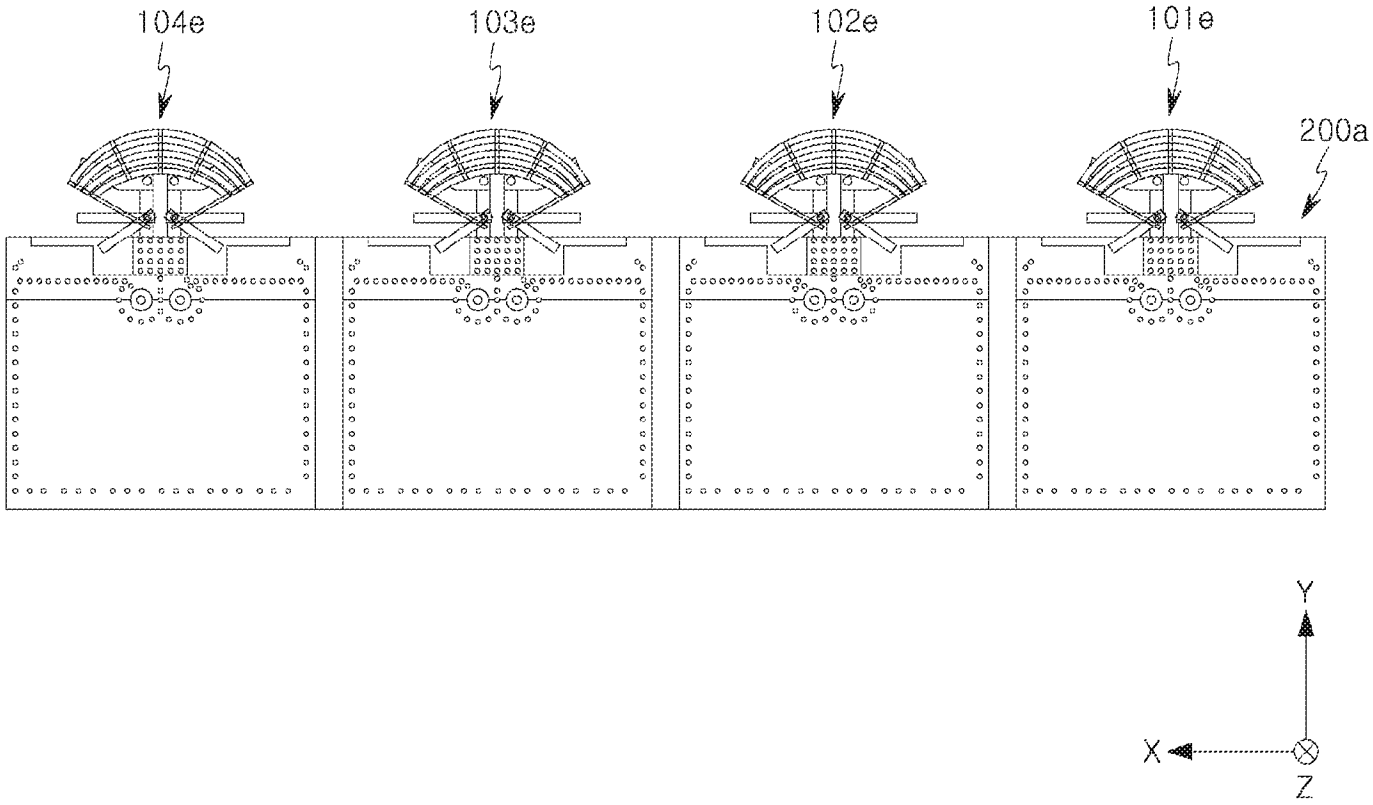
FIGS. 2A and 2B are plan views illustrating an arrangement of an antenna apparatus, according to an example.
Figure 2B:
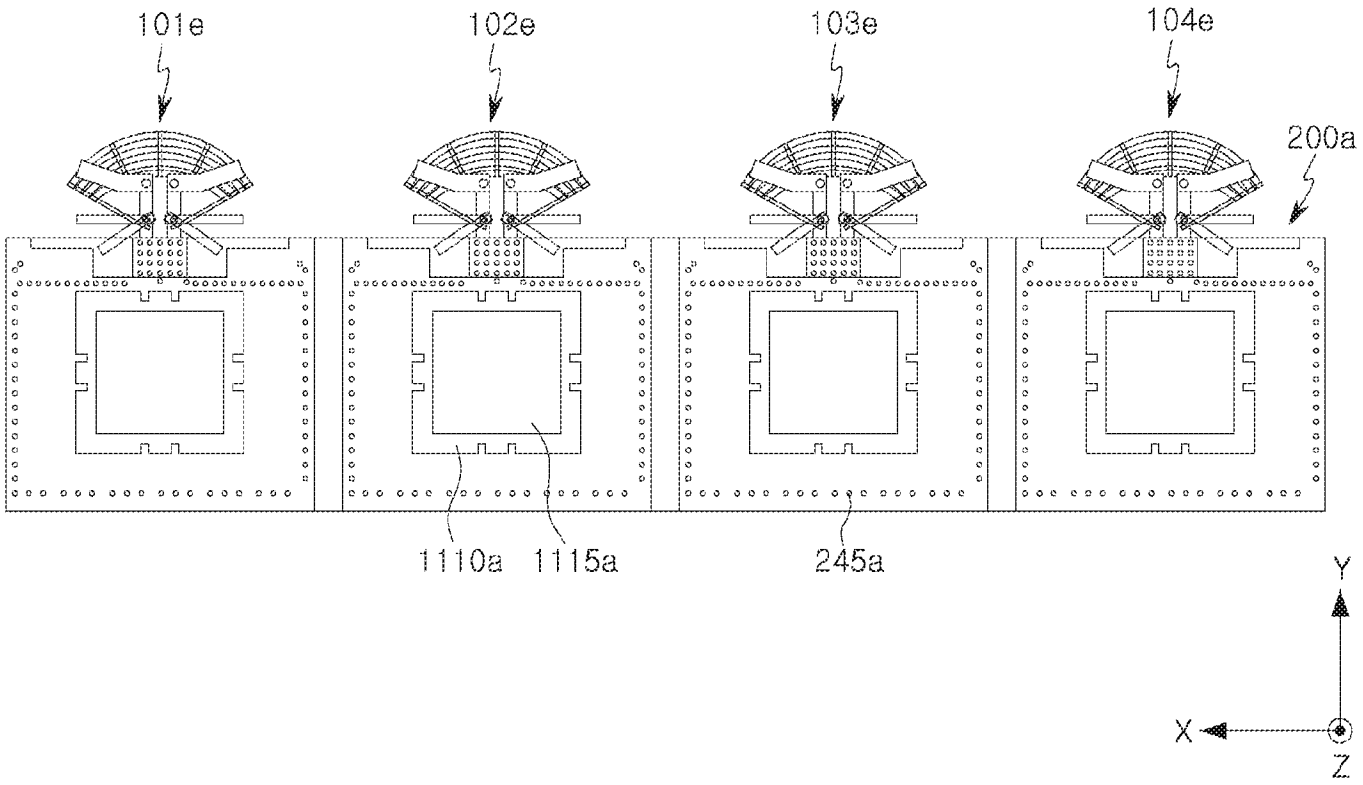

FIGS. 2A and 2B are plan views illustrating an arrangement of antenna apparatuses 101*e*, 102*e*, 103*e*, and 104*e*, according to an example.

Referring to FIGS. 2A and 2B, the antenna apparatuses 101*e*, 102*e*, 103*e*, and 104*e* according to an example may be arranged in an X direction, and may respectively concentrate radiation patterns in a Y direction. The antenna apparatuses 101*e*, 102*e*, 103*e*, and 104*e* may each have the same features and configuration as the antenna apparatus 100 described above with respect to FIGS. 1A to 1D.

Patch antenna patterns 1110*a* may be arranged in the Y direction, while being disposed above the connection member 200*a*, for example, in the Z direction, and radiation patterns of the patch antenna patterns 1110*a* may be concentrated in the Z direction. For example, upper coupling patterns 1115*a* may be disposed above the patch antenna patterns 1110*a* to be spaced apart from each other.

The connection member 200*a* may include shielding vias 245*a*.

FIGS. 3A to 3F are plan views illustrating various third end-fire antenna patterns of an antenna apparatus, according to examples.

Figure 3A:
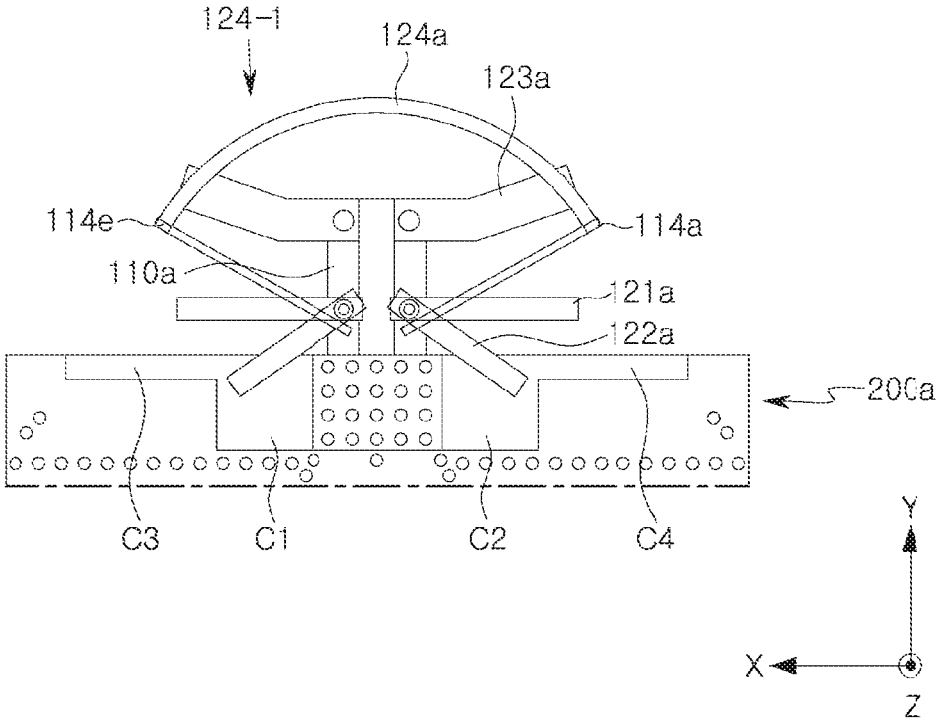
FIGS. 3A to 3F are plan views illustrating various third end-fire antenna patterns of an antenna apparatus, according to examples.

Referring to FIG. 3A, a third end-fire antenna pattern 124-1 may include one arc pattern 124*a* and two connection patterns 114*a* and 114*e*.

Figure 3B:
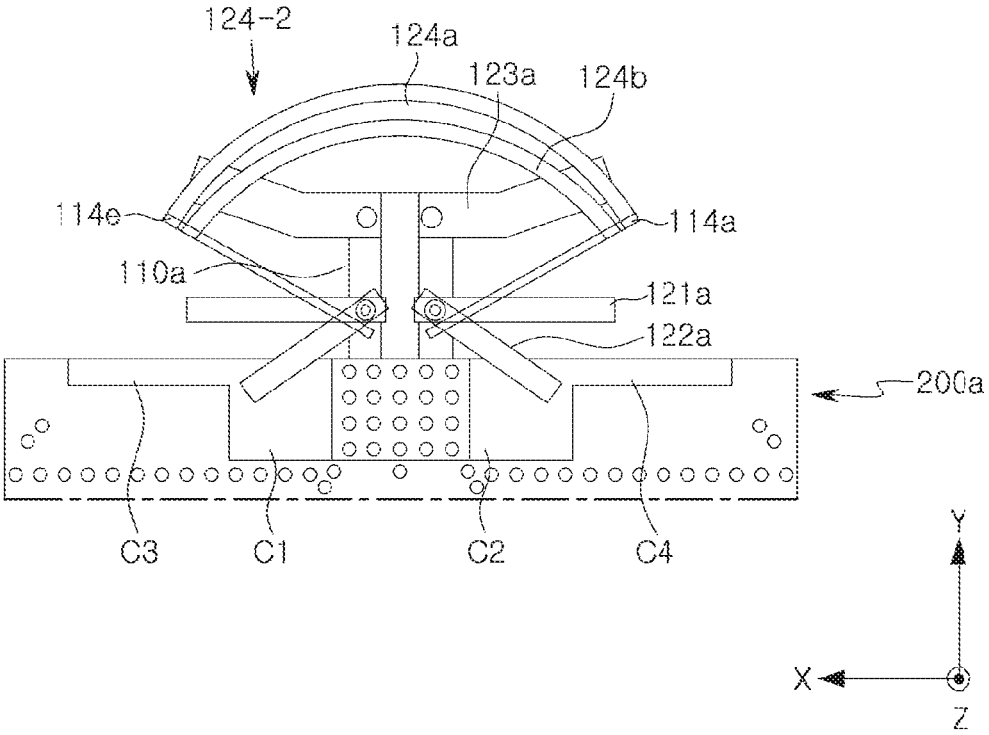

Referring to FIG. 3B, a third end-fire antenna pattern 124-2 may include two arc patterns 124*a* and 124*b* and two connection patterns 114*a* and 114*e*.

Figure 3C:
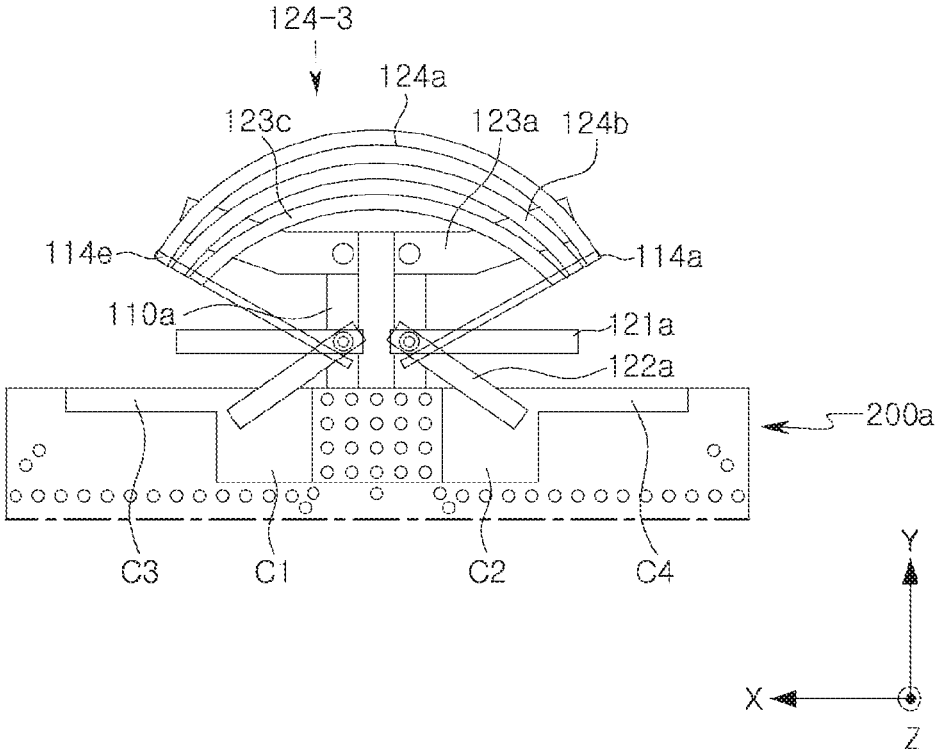

Referring to FIG. 3C, a third end-fire antenna pattern 124-3 may include of three arc patterns 124*a*, 124*b* and 124*c* and two connection patterns 114*a* and 114*e*.

Figure 3D:
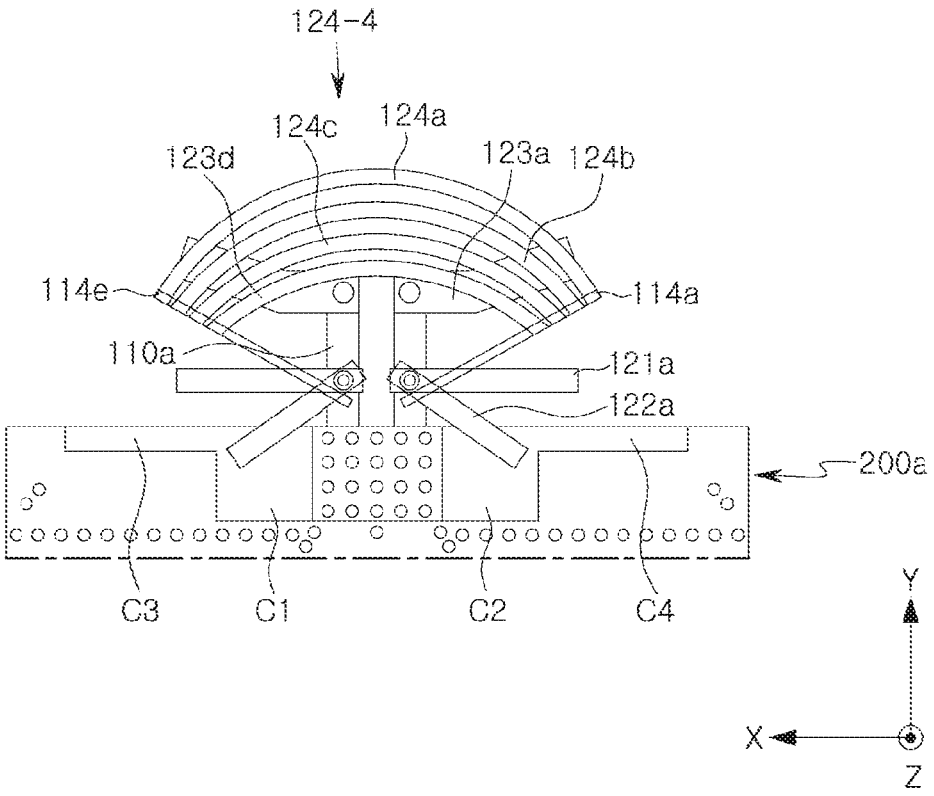

Referring to FIG. 3D, a third end-fire antenna pattern 124-4 may include four arc patterns 124*a*, 124*b*, 124*c* and 124*d* and two connection patterns 114*a* and 114*e*.

Figure 3E:
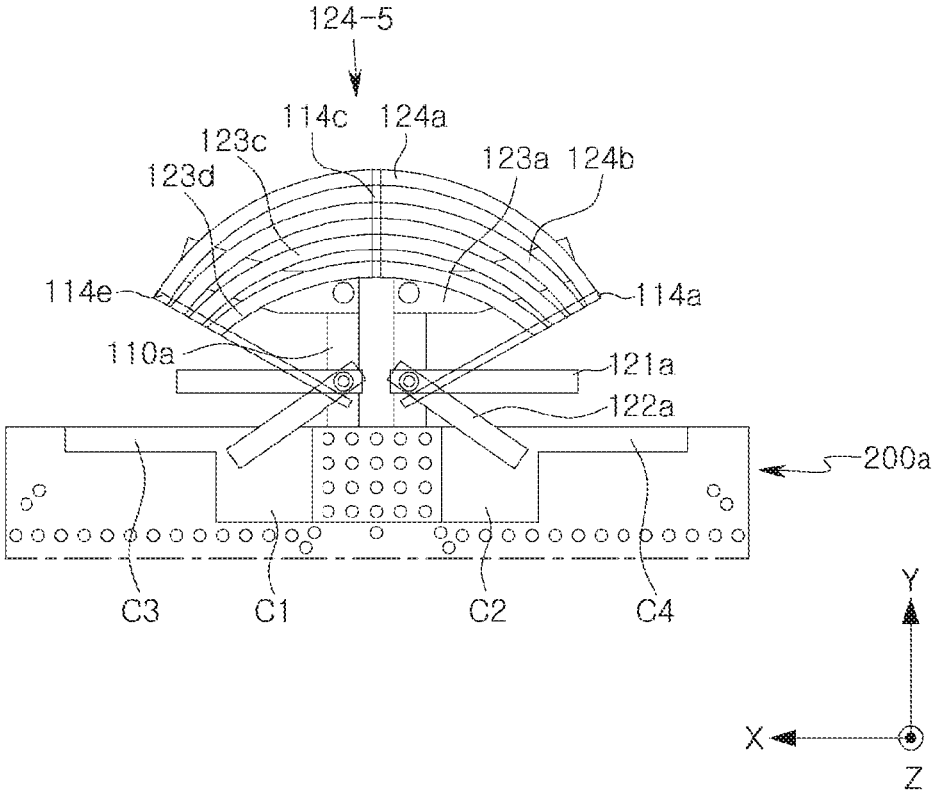

Referring to FIG. 3E, a third end-fire antenna pattern 124-5 may include four arc patterns 124*a*, 124*b*, 124*c* and 124*d* and three connection patterns 114*a*, 114*c* and 114*e*.

Figure 3F:
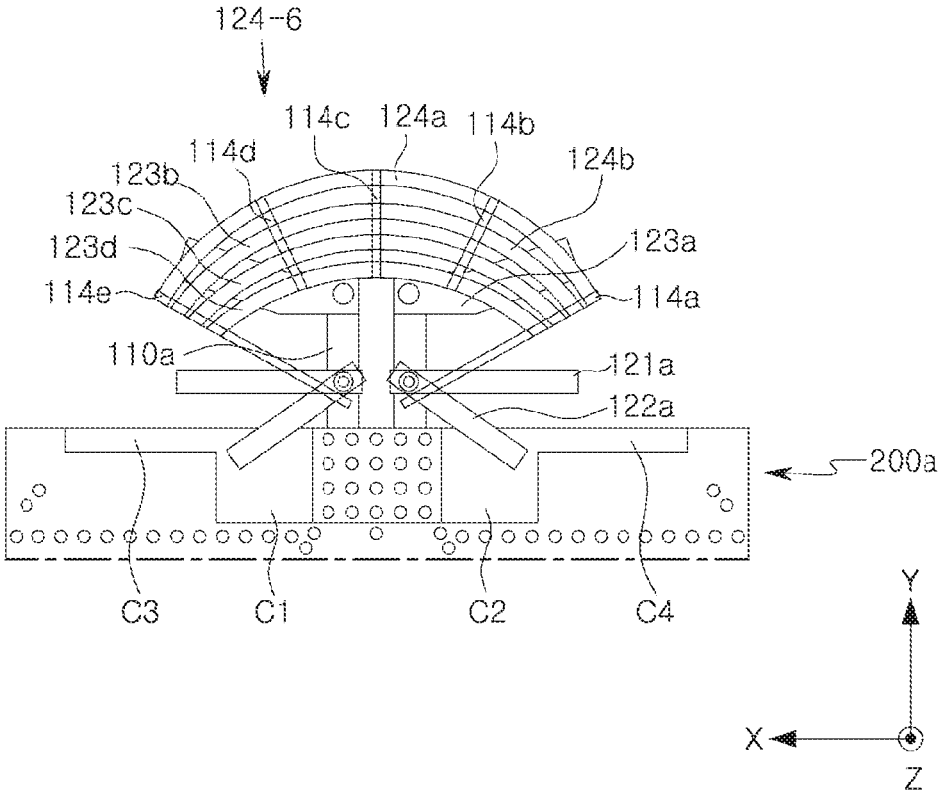

Referring to FIG. 3F, a third end-fire antenna pattern 124-6 may include four arc patterns 124*a*, 124*b*, 124*c* and 124*d* and five connection patterns 114*a*, 114*b*, 114*c*, 114*d* and 114*e*.

The structure of arc patterns 124*a*, 124*b*, 124*c*, and 124*d* and the connection patterns 114*a*, 114*b*, 114*c*, 114*d*, and 114*e* of the third end-fire antenna patterns may have a greater influence on a bandwidth and/or gain of a first frequency band (for example, of 24 GHz to 30 GHz) corresponding to a first RF signal, than an influence on a bandwidth and/or gain of a second frequency band (for example, of 38 GHz to 42 GHz) corresponding to a second RF signal.

Figure 4A:
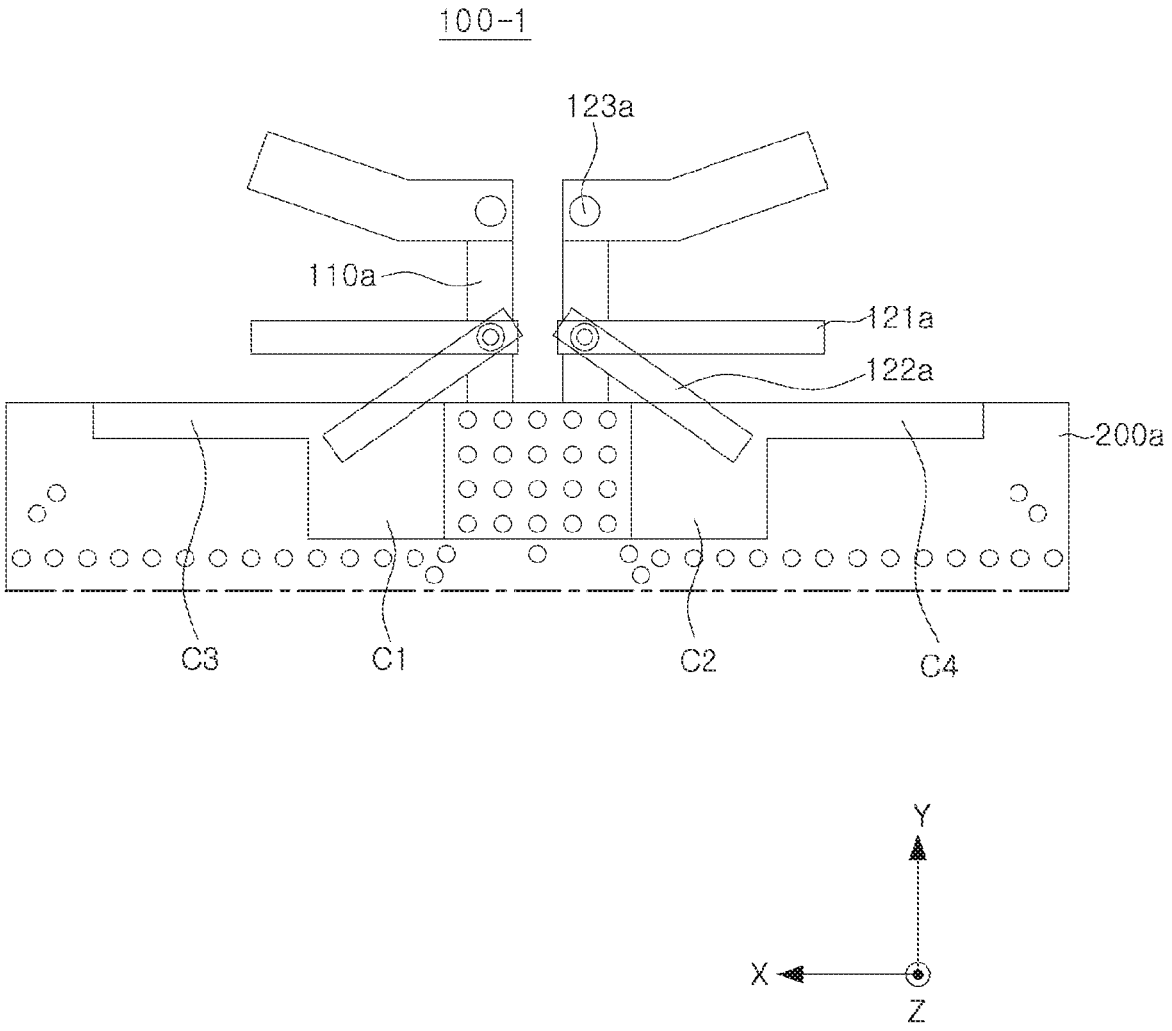
FIGS. 4A to 4C are plan views illustrating various structures of an antenna apparatuses, according to examples.
Figure 4B:
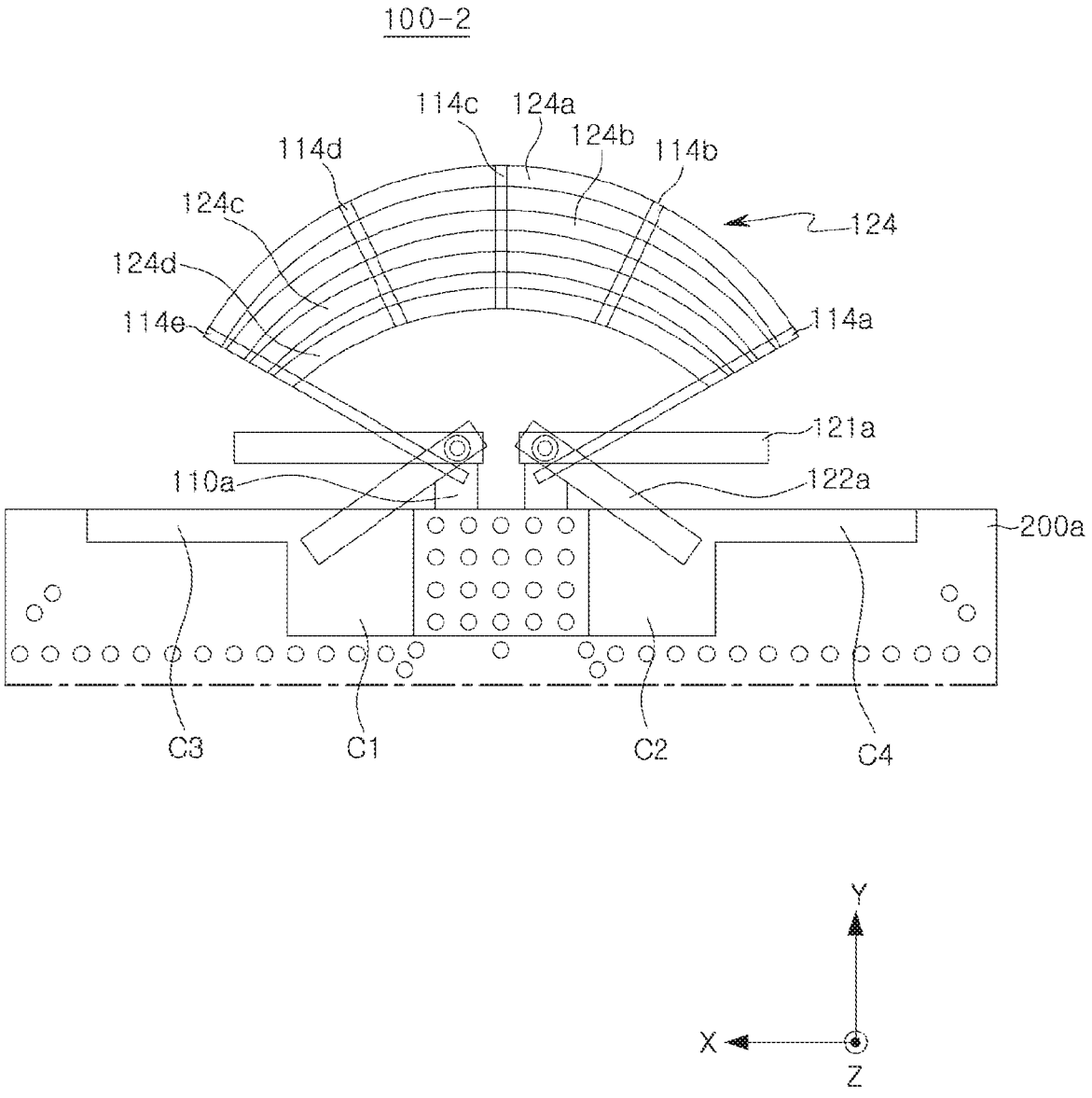
Figure 4C:
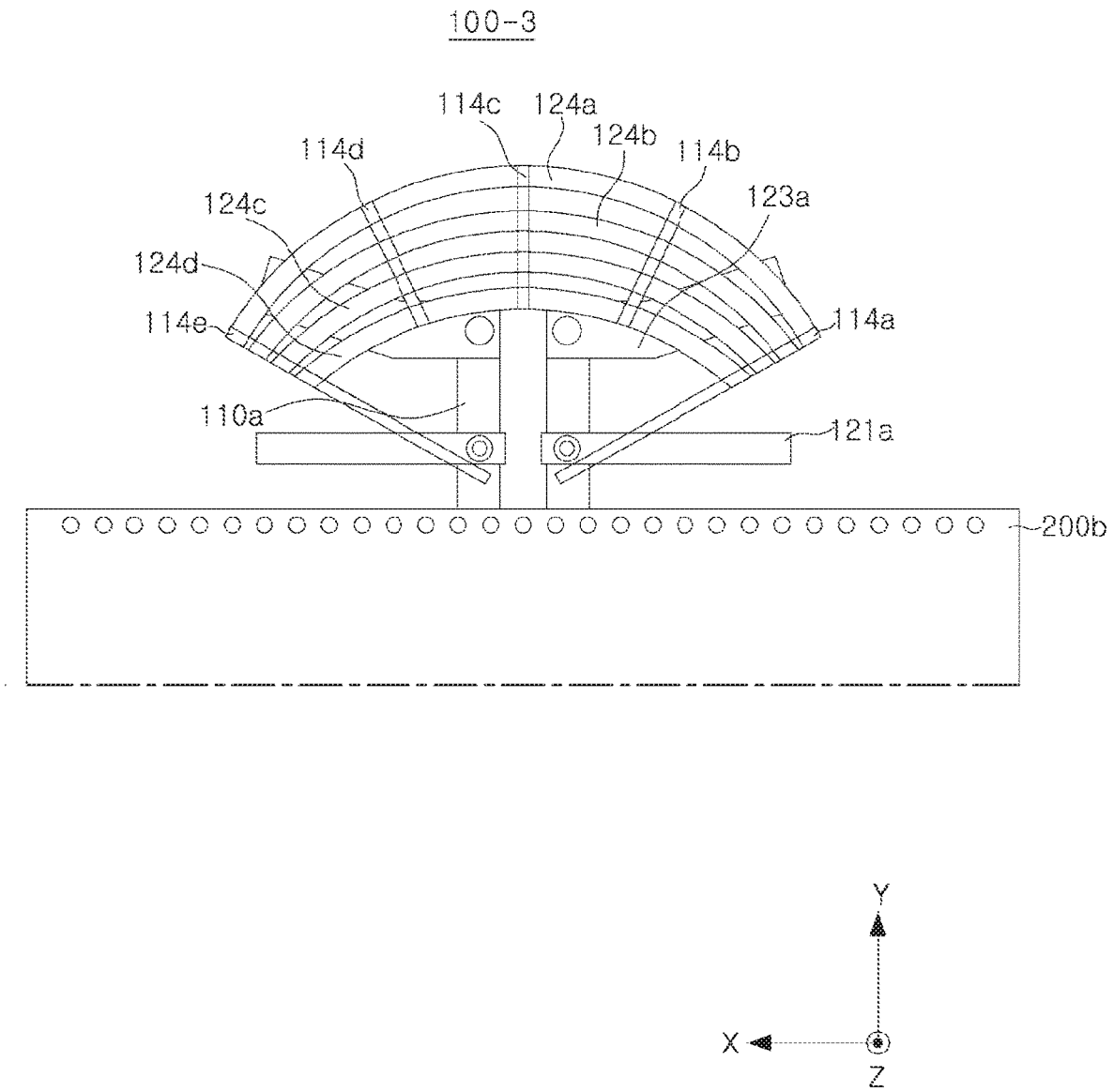

FIGS. 4A to 4C are plan views illustrating various structures of antenna apparatuses, according to an examples.

Referring to FIG. 4A, an antenna apparatus 100-1 includes first and second dipole patterns 121*a* and 122*a*, and a second end-fire antenna pattern 123*a*, but may not include a third end-fire antenna pattern. Accordingly, the antenna apparatus 100-1 may further improve a gain of the second RF signal while improving electromagnetic isolation between the first and second RF signals.

Referring to FIG. 4B, an antenna apparatus 100-2 includes first and second dipole pattern 11*s* 121*a* and 122*a*, and a third end-fire antenna pattern 124, but may not include a second end-fire antenna pattern.

For example, at least a portion of the third end-fire antenna pattern 124 may have a shape that is extended forward diagonally with respect to the first dipole pattern 121*a*. Accordingly, the antenna apparatus 100-2 may further improve the gain of the second RF signal while improving the electromagnetic isolation between the first and second RF signals.

Referring to FIG. 4C, a connection member 200*b* may have a shape that does not include a protruding region and a recessed region, and in this case, the second dipole pattern 122*a* may be omitted. For example, the first end-fire antenna may include only one of the first and second dipole patterns 121*a* and 122*a*, depending on the design.

FIGS. 5A to 5D are plan views sequentially illustrating, in an XY plane, ground planes of a connection member of an antenna apparatus, according to an example.

Figure 5A:
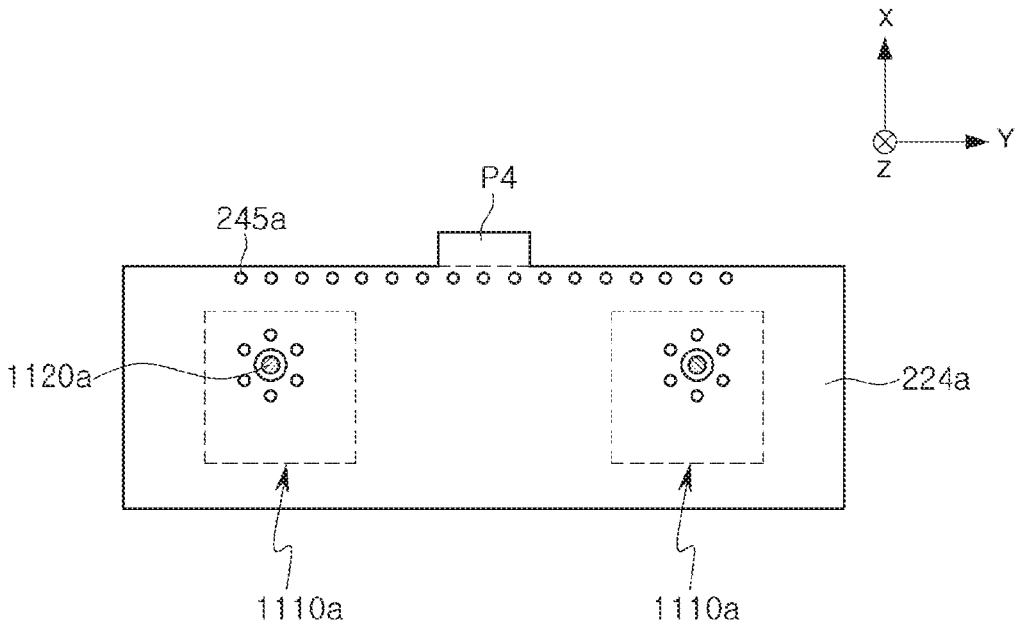
FIGS. 5A to 5D are plan views sequentially illustrating, in an XY plane, ground planes of a connection member of an antenna apparatus, according to an example.
Figure 5B:
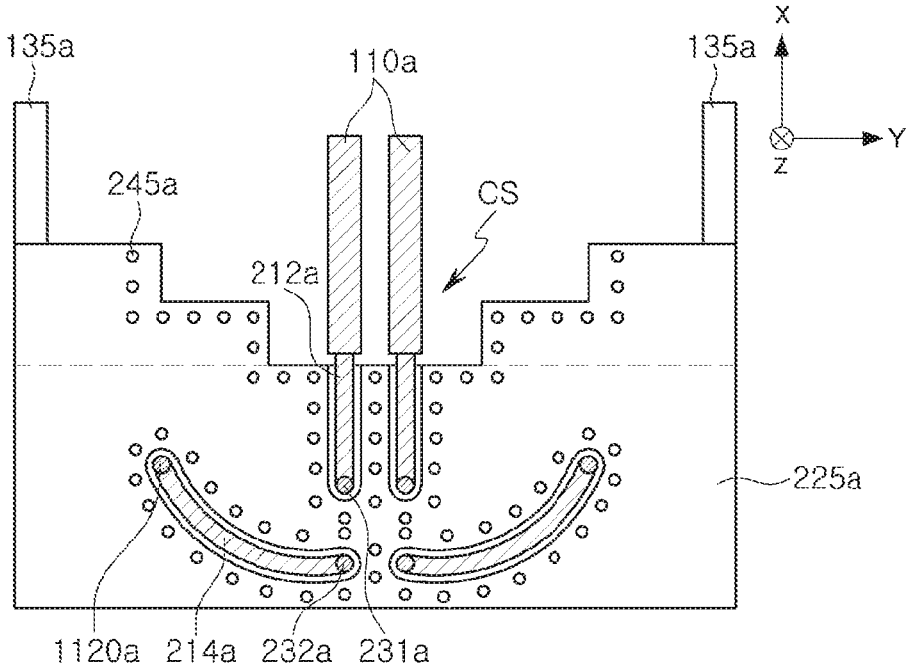
Figure 5C:
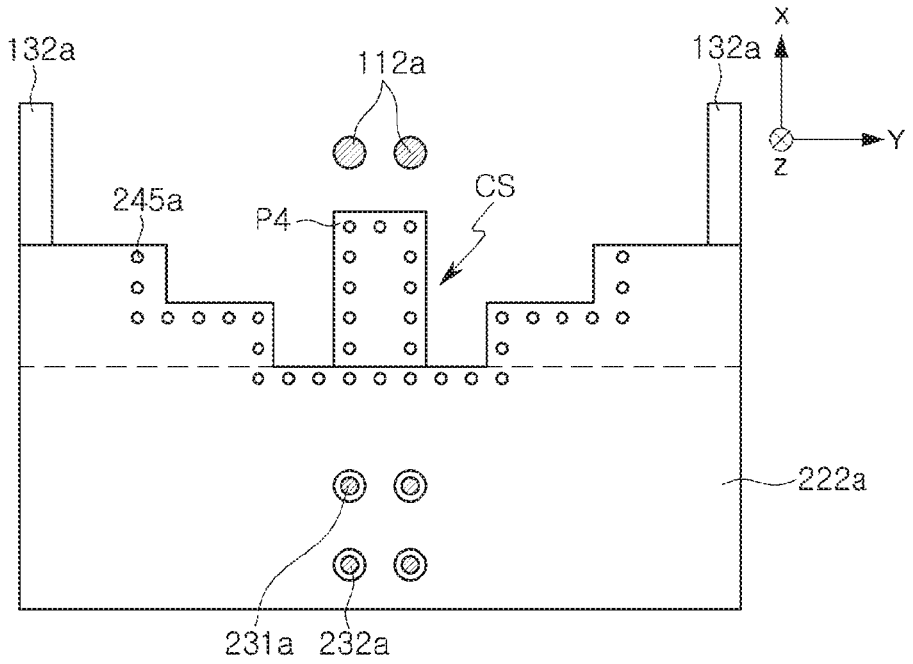
Figure 5D:
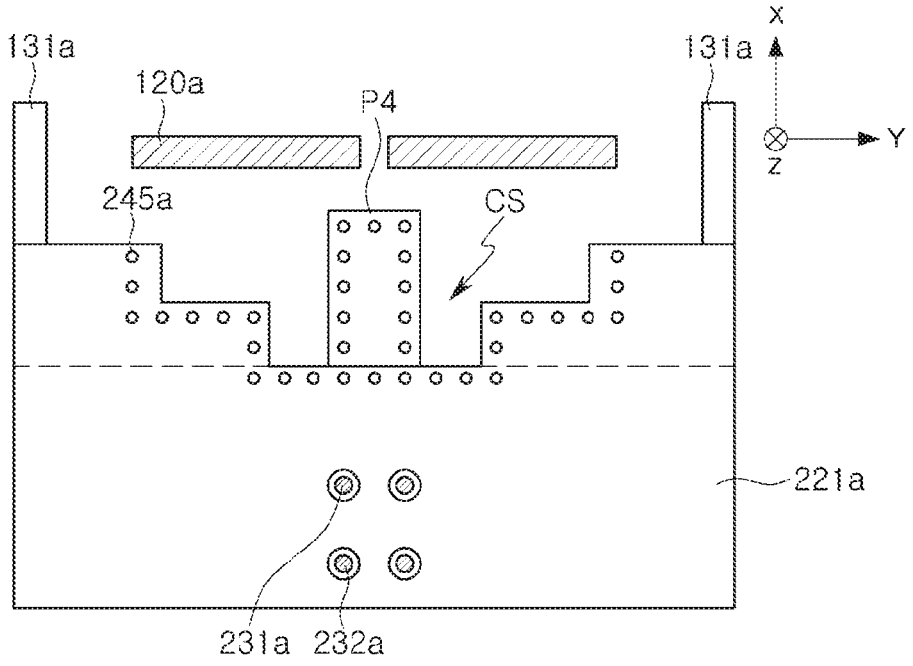

FIG. 5D only illustrates the first end-fire antenna pattern 120*a* among the first, second and third end-fire antenna patterns described above. The second and third end-fire antenna patterns described above not illustrated in FIGS. 5A to 5D in the interest of conciseness and improving clarity of the features shown in the drawings.

Referring to FIG. 5A, a first ground plane 224*a* may be disposed below the patch antenna patterns 1110*a*, may have through-holes through which second feed vias 1120*a* pass, and may include a first protruding region P4.

The patch antenna patterns 1110*a* may remotely transmit and/or receive RF signals in the Z direction. Accordingly, the antenna apparatus performs vertical transmission/reception of RF signals through the patch antenna patterns 1110*a*, as well as horizontal transmission/reception of RF signals through a dipole antenna pattern, thereby remotely transmitting and receiving the RF signals in all directions.

Referring to FIG. 5B, a second ground plane 225*a* may be disposed to respectively surround a second wiring 212*a* electrically connecting the feed line 110*a* and the first wiring via 231*b*, and a second wiring 214*a* electrically connecting a second feed via 1120*a* and a second wiring via 232*a*, and may be connected to a fifth blocking pattern 135*a*.

The shielding vias 245*a* may be arranged along a front boundary line of a stepped cavity CS and electrically connect the second ground plane 225*a* and a third ground plane 222*a* to each other.

Referring to FIG. 5C, the third ground plane 222*a* may include through-holes through which the first and second wiring vias 231*a* and 232*a* pass, and may be connected to a second blocking pattern 132*a*. The shielding vias 245*a* may be arranged along the front boundary line of the stepped cavity CS and may electrically connect the third ground plane 222*a* and a fourth ground plane 221*a* to each other. A via pattern 112*a* may be electrically connected to the dipole antenna pattern 120*a* (FIG. 5D).

Referring to FIG. 5D, the fourth ground plane 221*a* may have a shape recessed two times or more rearward of the first end-fire antenna pattern 120*a*, may include through-holes through which the first and second wiring vias 231*a* and 232*a* pass, and may be connected to the first blocking pattern 131*a*. The shielding vias 245*a* may be arranged along the front boundary line of the stepped cavity CS. The end-fire antenna pattern 120*a* may be disposed in front of the stepped cavity CS, for example, in an x direction.

Figure 6A:
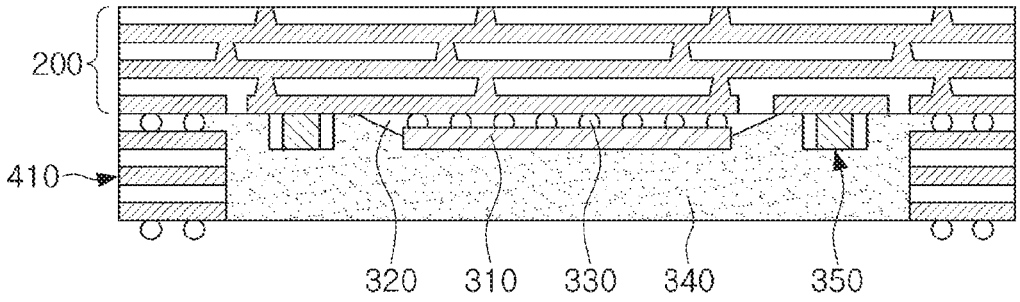
FIGS. 6A and 6B are views illustrating a lower structure of a connection member that may be included in the antenna apparatuses illustrated in FIGS. 1A to 5D, according to an example.
Figure 6B:
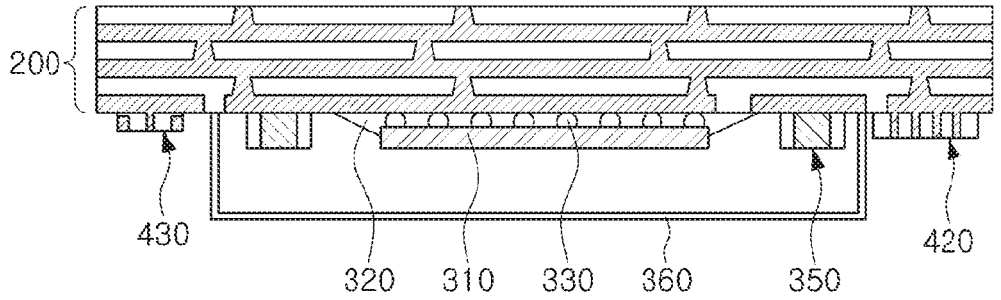

FIGS. 6A and 6B are views illustrating a lower structure of a connection member 200 that may be included in the antenna apparatuses illustrated in FIGS. 1A to 5D.

Referring to FIG. 6A, an antenna apparatus may include at least a portion of the connection member 200, an IC 310, an adhesive member 320, an electrical connection structure 330, an encapsulant 340, a passive component 350 and a sub-substrate 410.

The connection member 200 may have a structure similar to a structure of the connection members described above with reference to FIGS. 1A to 5D.

The IC 310 is the same as the above-described IC, and may be disposed below the connection member 200. The IC 310 may be electrically connected to the wiring of the connection member 200 to transmit or receive RF signals, and may be electrically connected to the ground plane of the connection member 200 to receive the ground. For example, the IC 310 may perform at least a portion of frequency conversion, amplification, filtering, phase control, and power generation to generate a converted signal.

The adhesive member 320 may bond the IC 310 and the connection member 200 to each other.

The electrical connection structure 330 may electrically connect the IC 310 and the connection member 200 to each other. For example, the electrical connection structure 330 may have a structure such as a solder ball, a pin, a land, or a pad. The electrical connection structure 330 may have a melting point lower than a melting point of the wiring and the ground plane of the connection member 200, and thus, may be formed to electrically connect the IC 310 and the connection member 200 to each other, using a process using the relatively low melting point.

The encapsulant 340 may seal at least a portion of the IC 310 and may improve heat radiation performance and shock protection performance of the IC 310. For example, the encapsulant 340 may be implemented as a Photo Imageable Encapsulant (PIE), an Ajinomoto Build-up Film (ABM), an epoxy molding compound (EMC), or the like.

The passive component 350 may be disposed on a lower surface of the connection member 200 and may be electrically connected to the wiring and/or the ground plane of the connection member 200 through the electrical connection structure 330.

The sub-substrate 410 may be disposed on a lower side of the connection member 200, and may be electrically connected to the connection member 200 to receive an intermediate frequency (IF) signal or a baseband signal externally and transmit the signal to the IC 310, or to receive the IF signal or the baseband signal from the IC 310 to transmit the signal externally. In this example, the frequency, for example, 24 GHz, 28 GHz, 36 GHz, 39 GHz, or 60 GHz, of the RF signal is greater than the frequency, for example, 2 GHz, 5 GHz, 10 GHz or the like, of the IF signal.

For example, the sub-substrate 410 may transmit the IF signal or the baseband signal to the IC 310 or may receive the signal from the IC 310 through a wiring that may be included in the IC ground plane of the connection member 200. Since a first ground plane of the connection member 200 is disposed between the IC ground plane and the wiring, the IF signal or the baseband signal and the RF signal may be electrically isolated from each other in an antenna module.

Referring to FIG. 6B, an antenna apparatus may include at least a portion of a shielding member 360, a connector 420, and a chip antenna 430.

The shielding member 360 may be disposed below the connection member 200 to confine the IC 310 together with the connection member 200. For example, the shielding member 360 may be disposed to cover together, for example, conformally shield, the IC 310 and the passive component 350, or to respectively cover, for example, compartmentally shield, the IC 310 and the passive component 350. For example, the shielding member 360 may have the form of a hexahedron of which one surface is open, and may have a receiving space having a hexahedral shape through coupling with the connection member 200. The shielding member 360 may be formed of a material having high conductivity, such as copper, to have a relatively short skin depth, and may be electrically connected to the ground plane of the connection member 200. Accordingly, the shielding member 360 may reduce electromagnetic noise that may affect the IC 310 and the passive component 350.

The connector 420 may have a connection structure of a cable (for example, a coaxial cable, or a flexible PCB), and may be electrically connected to the IC ground plane of the connection member 200. The connector 420 may perform a similar role as the sub-substrate 410 described above. For example, the connector 420 may receive an IF signal, a baseband signal, and/or power from a cable, or may provide an IF signal and/or a baseband signal to the cable.

The chip antenna 430 may transmit or receive an RF signal by assisting the antenna apparatus. For example, the chip antenna 430 may include a dielectric block having a dielectric constant greater than that of an insulating layer, and electrodes disposed on both surfaces of the dielectric block. One of the electrodes may be electrically connected to the wiring of the connection member 200, and the other one of the electrodes may be electrically connected to the ground plane of the connection member 200.

Figure 7A:
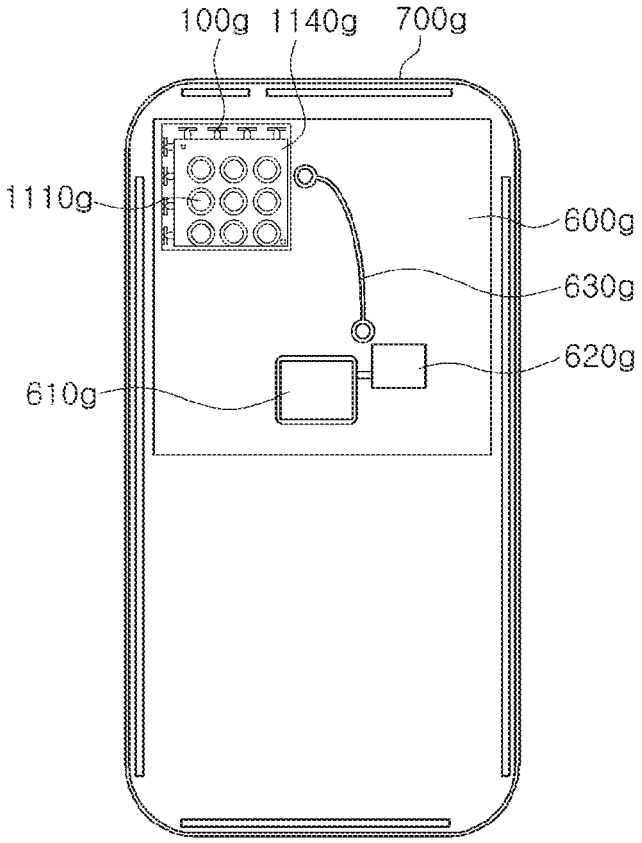
FIGS. 7A and 7B are plan views illustrating arrangements of antenna apparatuses in electronic devices, according to examples.
Figure 7B:
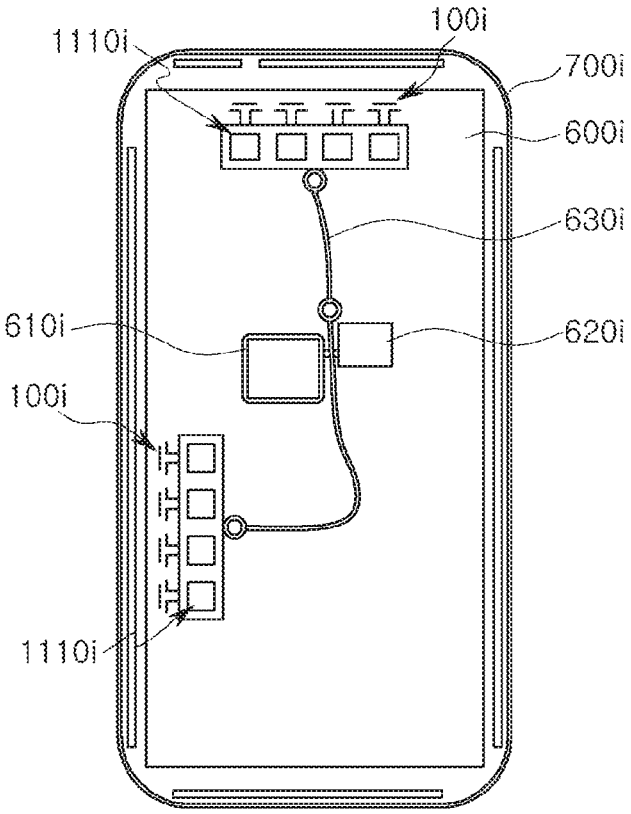

FIGS. 7A and 7B are plan views illustrating arrangements of antenna apparatuses in electronic devices according to an example.

Referring to FIG. 7A, an antenna module including an antenna apparatus 100*g*, a patch antenna pattern 1110*g*, and a dielectric layer 1140*g* may be disposed on a set substrate 600*g* of an electronic device 700*g* to be adjacent to a lateral boundary of the electronic device 700*g*.

The electronic device 700*g* may be a smartphone, a personal digital assistant, a digital video camera, a digital still camera, a network system, a computer, a monitor, a tablet PC, a laptop computer, a netbook, a television set, a video game, a smartwatch, an automobile, or the like, but is not limited to the foregoing examples.

A communications module 610*g* and a baseband circuit 620*g* may also be disposed on the set substrate 600*g*. The antenna module may be electrically connected to the communications module 610*g* and/or the baseband circuit 620*g* via a coaxial cable 630*g*.

The communications module 610*g* may include at least a portion of a memory chip such as a volatile memory (for example, a dynamic random access memory (DRAM)), a nonvolatile memory (for example, a read only memory (ROM)), a flash memory, or the like; an application processor chip such as a central processor (for example, a central processing unit (CPU)), a graphics processor (for example, a graphics processing unit (GPU)), a digital signal processor, a cryptographic processor, a microprocessor, a microcontroller, or the like; and a logic chip such as an analog-to-digital (ADC) converter, an application-specific integrated circuit (ASIC), or the like, to perform digital signal processing.

The baseband circuit 620*g* may perform analog-to-digital conversion, amplification for an analog signal, filtering, and frequency conversion to generate a base signal. A base signal input/output from the baseband circuit 620*g* may be transmitted to the antenna module via a cable.

For example, the base signal may be transmitted to the IC through the electrical connection structure, the core via, and the wiring. The IC may convert the base signal into an RF signal in a millimeter wave (mmWave) band.

Referring to FIG. 7B, antenna modules each including an antenna apparatus 100*i* and a patch antenna pattern 1110*i* may be respectively disposed adjacent to the centers of sides of an electronic device 700*i* having a polygonal shape, on a set substrate 600*i* of an electronic device 700*i*, and a communications module 610*i* and a baseband circuit 620*i* may also be disposed on the set substrate 600*i*. The antenna apparatuses 100*i* and the antenna modules may be electrically connected to the communications module 610*i* and/or the baseband circuit 620*i* through a coaxial cable 630*i*.

The end-fire antenna patterns, the feed lines, the feed vias, the ground planes, the patch antenna patterns, the shielding vias, and the electrical connection structures described in the examples may include a metal material, for example, a conductive material, such as copper (Cu), aluminum (Al), silver (Ag), tin (Sn), gold (Au), nickel (Ni), lead (Pb), titanium (Ti), or alloys thereof, and may be formed depending on a plating method, such as chemical vapor deposition (CVD), physical vapor deposition (PVD), sputtering, subtractive, additive, a semi-additive process (SAP), a modified semi-additive process (MSAP), or the like. However, the materials and formation methods of the end-fire antenna patterns, the feed lines, the feed vias, the ground planes, the patch antenna patterns, the shielding vias, and the electrical connection structures are not limited to the foregoing examples.

The dielectric layer and/or the insulating layer described in the examples may also be implemented by FR4, Liquid Crystal Polymer (LCP), Low Temperature Co-fired Ceramic (LTCC), a thermosetting resin such as epoxy resin, a thermoplastic resin such as polyimide, or a resin formed by impregnating these resins in a core material such as a glass fiber, a glass cloth, a glass fabric, or the like, together with an inorganic filler, a prepreg resin, Ajinomoto Build-up Film (ABF) resin, Bismaleimide Triazine (BT) resin, a photoimageable dielectric (PID) resin, a copper clad laminate (CCL), an insulating material of glass or ceramic series, or the like. The dielectric layer and/or the insulating layer may fill at least a portion of the antenna apparatus in which the end-fire antenna pattern, the feed line, the feed via, the ground plane, the patch antenna pattern, the shielding via, and the electrical connection structure are not disposed.

The RF signals described in the examples may be used in various communications protocols such as Wi-Fi (IEEE 802.11 family or the like), WiMAX (IEEE 802.16 family or the like), IEEE 802.20, Long Term Evolution (LTE), Ev-DO, HSPA+, HSDPA+, HSUPA+, EDGE, GSM, GPS, GPRS, CDMA, TDMA, DECT, Bluetooth, 3rd Generation (3G), 4G, 5G, and various wireless and wired protocols designated thereafter, but an example thereof is not limited thereto.

As set forth above, an antenna apparatus, according to an example, may improve antenna performance, for example, gain, bandwidth, directivity, transmission/reception rates, or the like, and may be easily miniaturized, while providing transmission/reception units in different frequency bands.

The communication modules 610*g* and 610*i* in FIGS. 7A and 7B that perform the operations described in this application are implemented by hardware components configured to perform the operations described in this application that are performed by the hardware components. Examples of hardware components that may be used to perform the operations described in this application where appropriate include controllers, sensors, generators, drivers, memories, comparators, arithmetic logic units, adders, subtractors, multipliers, dividers, integrators, and any other electronic components configured to perform the operations described in this application. In other examples, one or more of the hardware components that perform the operations described in this application are implemented by computing hardware, for example, by one or more processors or computers. A processor or computer may be implemented by one or more processing elements, such as an array of logic gates, a controller and an arithmetic logic unit, a digital signal processor, a microcomputer, a programmable logic controller, a field-programmable gate array, a programmable logic array, a microprocessor, or any other device or combination of devices that is configured to respond to and execute instructions in a defined manner to achieve a desired result. In one example, a processor or computer includes, or is connected to, one or more memories storing instructions or software that are executed by the processor or computer. Hardware components implemented by a processor or computer may execute instructions or software, such as an operating system (OS) and one or more software applications that run on the OS, to perform the operations described in this application. The hardware components may also access, manipulate, process, create, and store data in response to execution of the instructions or software. For simplicity, the singular term "processor" or "computer" may be used in the description of the examples described in this application, but in other examples multiple processors or computers may be used, or a processor or computer may include multiple processing elements, or multiple types of processing elements, or both. For example, a single hardware component or two or more hardware components may be implemented by a single processor, or two or more processors, or a processor and a controller. One or more hardware components may be implemented by one or more processors, or a processor and a controller, and one or more other hardware components may be implemented by one or more other processors, or another processor and another controller. One or more processors, or a processor and a controller, may implement a single hardware component, or two or more hardware components. A hardware component may have any one or more of different processing configurations, examples of which include a single processor, independent processors, parallel processors, single-instruction single-data (SISD) multiprocessing, single-instruction multiple-data (SIMD) multiprocessing, multiple-instruction single-data (MISD) multiprocessing, and multiple-instruction multiple-data (MIMD) multiprocessing.

Instructions or software to control computing hardware, for example, one or more processors or computers, to implement the hardware components and perform the methods as described above may be written as computer programs, code segments, instructions or any combination thereof, for individually or collectively instructing or configuring the one or more processors or computers to operate as a machine or special-purpose computer to perform the operations that are performed by the hardware components and the methods as described above. In one example, the instructions or software include machine code that is directly executed by the one or more processors or computers, such as machine code produced by a compiler. In another example, the instructions or software includes higher-level code that is executed by the one or more processors or computer using an interpreter. The instructions or software may be written using any programming language based on the block diagrams and the flow charts illustrated in the drawings and the corresponding descriptions in the specification, which disclose algorithms for performing the operations that are performed by the hardware components and the methods as described above.

The instructions or software to control computing hardware, for example, one or more processors or computers, to implement the hardware components and perform the methods as described above, and any associated data, data files, and data structures, may be recorded, stored, or fixed in or on one or more non-transitory computer-readable storage media. Examples of a non-transitory computer-readable storage medium include read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, magnetic tapes, floppy disks, magneto-optical data storage devices, optical data storage devices, hard disks, solid-state disks, and any other device that is configured to store the instructions or software and any associated data, data files, and data structures in a non-transitory manner and provide the instructions or software and any associated data, data files, and data structures to one or more processors or computers so that the one or more processors or computers can execute the instructions. In one example, the instructions or software and any associated data, data files, and data structures are distributed over network-coupled computer systems so that the instructions and software and any associated data, data files, and data structures are stored, accessed, and executed in a distributed fashion by the one or more processors or computers.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus, comprising:

a feed line;

a ground plane disposed around a portion of the feed line;

a feed via electrically connected to the feed line;

a first end-fire antenna pattern disposed in front of the ground plane to be spaced apart from the ground plane, and electrically connected to the feed via;

a second end-fire antenna pattern electrically connected to the feed line and disposed farther forward than the first end-fire antenna pattern; and a third end-fire antenna pattern electrically connected to the feed via, and disposed in front of the first end-fire antenna pattern in such a manner that a portion of the third end-fire antenna pattern overlaps the second end-fire antenna pattern.

2. The antenna apparatus of claim 1, wherein the second end-fire antenna pattern is an open type pattern, and the third end-fire antenna pattern is a closed type pattern.

3. The antenna apparatus of claim 1, wherein the second end-fire antenna pattern has a shape bent diagonally with respect to a front direction of the antenna apparatus.

4. The antenna apparatus of claim 1, wherein a portion of the third end-fire antenna pattern has an arc shape.

5. The antenna apparatus of claim 4, wherein the third end-fire antenna pattern comprises:

arc patterns, each having an arc shape; and connection patterns electrically connecting the arc patterns to each other.

6. The antenna apparatus of claim 5, wherein a spacing distance between the arc patterns at centers of the arc patterns is greater than a spacing distance between the arc patterns at ends of the arc patterns.

7. The antenna apparatus of claim 5, wherein a width of each of the arc patterns is less than a width of the second end-fire antenna pattern.

8. The antenna apparatus of claim 5, wherein a width of each of the connection patterns is less than a width of the feed line.

9. The antenna apparatus of claim 1, wherein a width of the second end-fire antenna pattern is greater than a width of the first end-fire antenna pattern.

10. The antenna apparatus of claim 1, wherein a portion of the first end-fire antenna pattern has a shape extending obliquely with respect to a rearward direction of the antenna apparatus.

11. The antenna apparatus of claim 10, wherein the first end-fire antenna pattern comprises:

a first dipole pattern electrically connected to the feed via; and a second dipole pattern electrically connected to the feed via and having a shape extending rearwardly, obliquely with respect to the first dipole pattern.

12. The antenna apparatus of claim 11, wherein the ground plane comprises a recessed region in which a portion of the second dipole pattern is located.

* * * * *